United States Patent [19]

Knoble

[11] 4,332,233

[45] Jun. 1, 1982

[54] BOW-STRING RELEASE DEVICE

[76] Inventor: Herman W. Knoble, 40 Moraine Rd., Pittsburgh, Pa. 15239

[21] Appl. No.: 157,212

[22] Filed: Jun. 9, 1980

[51] Int. Cl.[3] ..... A41B 5/00

[52] U.S. Cl. ..... 124/35 A; 2/21

[58] Field of Search ..... 124/35 A, 35 R, 41 A, 124/23 R; 2/21, 161 A; 273/144

[56] References Cited

U.S. PATENT DOCUMENTS 3,608,090 1/1970 Wilson et al. ..... 124/35 A X

*Primary Examiner*—Richard C. Pinkham
*Assistant Examiner*—William R. Browne
*Attorney, Agent, or Firm*—James Irwin

[57] ABSTRACT

An archer's hand plate adapted to be worn on an archer's hand when drawing and releasing a bow string and arrow is disclosed. The device is designed to increase accuracy and reproducibility in shooting arrows. The device comprises a base plate designed to fit in the palm of the archer's hand and to keep the back of the hand substantially flat and in line with fingers of the hand up to the first joint thereof, thereby maintaining knuckles of the fingers in line, the base plate having a leading edge, a rear portion and a top portion connecting the leading edge and rear portion, the leading edge shaped to coincide with at least the index finger and middle finger of the hand and to require said fingers to bend at the first joint thereof when the hand is closed about the base plate.

5 Claims, 4 Drawing Figures

FIG. 1.
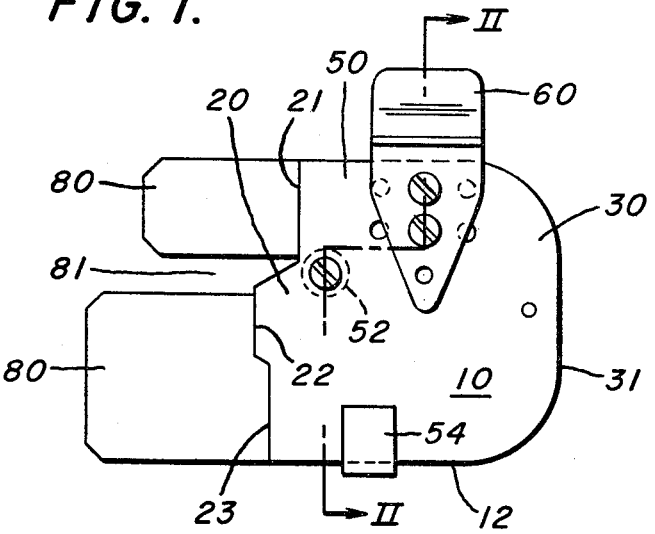
FIG. 2.
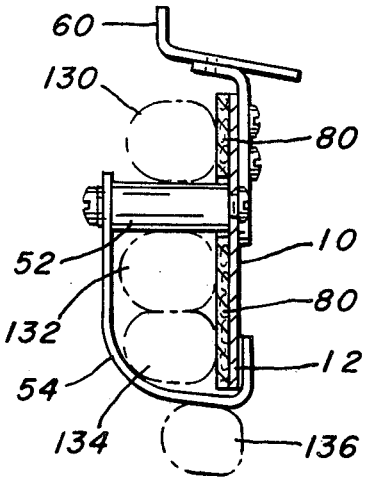
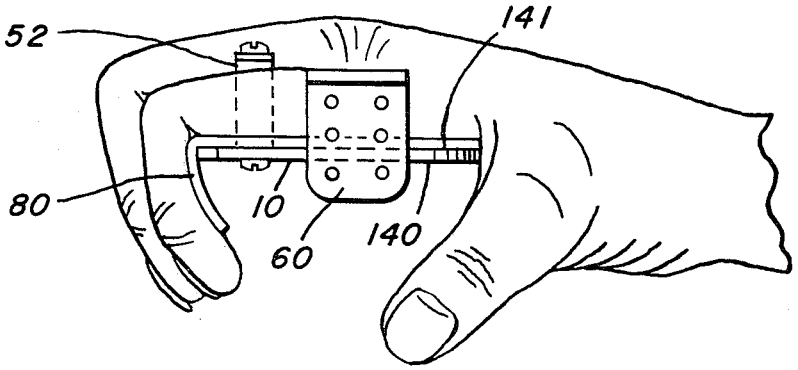
FIG. 4.
FIG. 3.
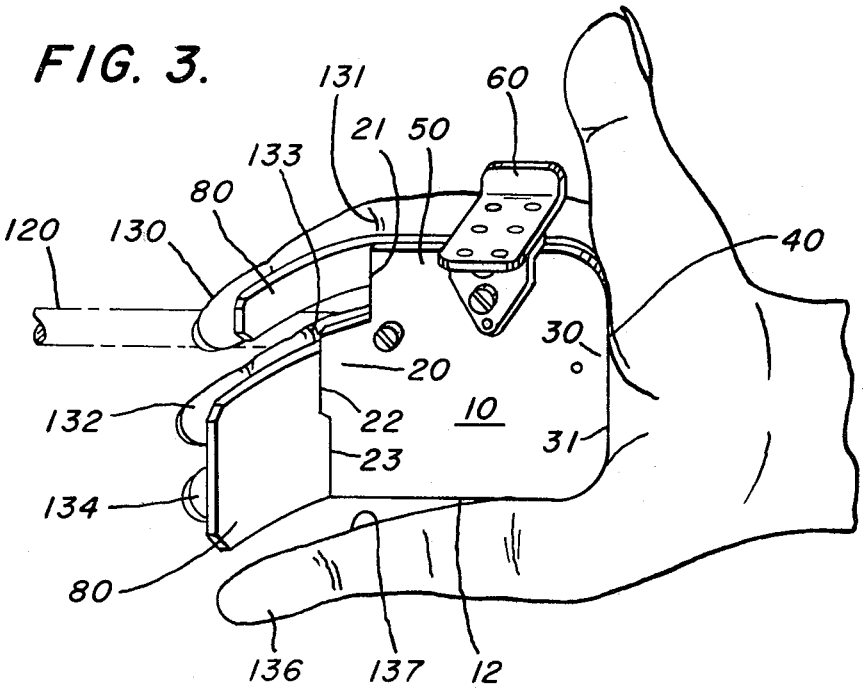

BOW-STRING RELEASE DEVICE

INTRODUCTION

This invention relates to archery and more particularly it relates to an archer's hand plate which is designed to increase accuracy and reproducibility on shooting arrows from a bow.

In the field of archery there is great interest in not only being accurate with one arrow but in the accuracy in shooting a number or cluster of arrows. That is, there is great interest in reproducibility with respect to shooting a number of arrows. With respect to such interest, various articles have been proposed to aid the archer. For example, U.S. Pat. No. 3,880,136 discloses the use of a steady rest in the form of a chin rest to be worn on the archer's hand. U.S. Pat. No. 3,604,407 discloses a bowstring-pulling device for facilitating pulling back and releasing a bowstring, the device also including a chin rest. U.S. Pat. No. 2,084,634 also discloses a chin rest and a grip member. U.S. Pat. No. 3,291,111 discloses a mouth supported anchor nock for a bow string; U.S. Pat. No. 3,246,338 discloses a bow string tension and finger protector; U.S. Pat. No. 3,929,372 shows a wrist draw for archers; U.S. Pat. Nos. 2,834,018 and 2,903,701 disclose finger protection for archers; and U.S. Pat. Nos. 3,608,090 and 2,996,059 show a tab to protect the fingers and a wrist attachment for use in facilitating the drawing of the bow string. All of these features are provided with the idea of increasing accuracy. However, after intensive investigation it has been found one of the most important features in reproducing accuracy involves maintaining the hand used for pulling the bow string substantially flat and in line with the fingers of said hand up to the first joint thereof. Accordingly, the present invention provides such a device to be worn in the archer's hand when drawing and releasing the bow string and arrow.

SUMMARY OF THE INVENTION

An object of the invention is to provide an archer's hand plate adapted to be worn in an archer's hand when drawing and releasing a bow string and arrow.

Another object of the invention is to provide an archer's hand plate designed to fit in the palm of the archer's hand when drawing and releasing a bow string and arrow.

Yet, another object of the invention is to provide an archer's hand plate device designed to keep the archer's hand substantially flat and in line with fingers of said hand up to the first joint thereof.

These and other objects of the invention will become apparent from the drawings, specification and claims appended hereto.

In accordance with the objects of the invention there is provided an archer's hand plate device adapted to be worn in an archer's hand when drawing and releasing a bow string and arrow, the device designed to increase accuracy and reproducibility in groups of arrow shots. The device comprises a base plate designed to fit in the palm of the archer's hand and to keep the back of said hand substantially flat and in line with fingers of the hand up to the first joint thereof, thereby maintaining knuckles of said fingers in line, the base plate being substantially flat, having a leading edge, a rear portion and top portion connecting the leading edge and rear portion, the leading edge shaped to coincide with and to require at least the index finger and middle finger of said hand to bend at the first joint of said fingers when the hand is closed about said base plate, the rear portion of said plate designed to fit and anchor against the heel of said hand when the hand is closed about said base plate. The device can have a finger spacer mounted on said base plate to fit between said index finger and said middle finger. An adjustable chin rest, finger protector, finger spacer and attaching means can be provided on the archery hand plate to cooperate therewith in aiding the accuracy of the archer in shooting arrows from an archery bow.

BRIEF DESCRIPTION OF THE DRAWINGS

FIG. 1 is a side view of the archer's hand plate device.

FIG. 2 is a sectional front view of the archer's hand plate through the line II—II of FIG. 1.

FIG. 3 is a perspective view of the archer's hand plate located in the palm of the archer's hand, showing the leading edge thereof shaped and coinciding with the first joint of the first or index finger and the middle finger.

FIG. 4 is a top view of the device in the archer's hand showing the hand being maintained substantially flat up to the first joints of at least the first and middle fingers.

DETAILED DESCRIPTION OF THE PREFERRED EMBODIMENTS

Referring now to FIG. 1, there is shown a side view of the archer's hand plate 10 having a leading edge referred to generally as 20 and a rear portion 30 designed to fit into the heel of the archer's hand 40 (see FIG. 3). Hand plate 10 has a top portion 50 which can be adpated to carry chin rest 60. A finger protector 80 may be provided on the hand plate, finger protector 80 having a slot 81 provided therein for purposes of passing the arrow shaft 120 (FIG. 3) therethrough when drawing the bow.

With respect to leading edge 20 of the hand plate, it will be seen from an inspection of FIGS. 1 and 3 that a portion thereof, referred to as 21, which portion is shaped or provided in a length which when held in the archer's hand when drawing an arrow in a bow ensures that index finger 130 (FIG. 3) of the hand bends at joint 131 or the first joint thereof. Leading edge 20 has a second portion 22 which requires middle finger 132 to bend at the first joint or joint 133 when the hand plate is held in the archer's hand, when pulling or drawing the arrow and bow string. Likewise, a third portion 23 can be provided on hand plate 10 to require third finger 134 of the hand to bend at the first joint thereof. While the leading edge may not always require third portion 23, it should be noted that this portion adds greatly to comfort and balance when the plate is held in the hand and is therefore a preferred aspect of the invention. In addition, it should be noted that leading edge 20 of the hand plate does not extend to fourth finger 136 and this is another preferred aspect of the invention. As presently understood, comfort and balance of the hand plate is best obtained when the leading edge is extended to between the third and fourth fingers substantially as shown in FIG. 3. Accordingly, preferably the hand plate has a bottom edge 12, at least a portion of which extends back or rearwardly of the fingers above upper portion 137 of finger 136 (FIG. 3).

Rear portion 30 which fits into heel 40 of the archer's hand is shown having a substantial straight edge 31.

However, it should be understood that edge 31 may be sculptured or shaped to fit the heel of the hand more comfortably, if desired. Also, top portion 50 is not normally required to extend above the hand except where it may be desirable when a chin rest is provided.

Hand plate 10 is shown in the FIGS. as being generally flat. That is, both sides, 140 and 141 (FIG. 4) are generally flat. This is an important feature of the hand plate since this construction is adapted to or functions to keep the back of the hand substantially flat and in line with fingers of the hand up to the first joint thereof as may be best seen in FIG. 4. In this way the hand plate aids in keeping at least the index and middle fingers of the archer's hand in a relatively constant position in relation to each other and to the palm of the hand. This provides much less variation in the movement of the hand in successive shots and results in increased accuracy in groups of shots. It should be noted that maintaining hand and fingers in this relationship also maintains the knuckles of the fingers in line also aiding reproducibility in groups of shots.

A finger protector 80 may be provided on the hand plate without interfering with the function of the plate. The finger protector may be fabricated from a soft, pliable material such as leather which is designed to protect against or avoid abrasion or cuts to the fingers upon pulling the string of the bow. In the protector shown, a slot is provided for purposes of passing the arrow shaft therethrough. The protector is conveniently attached to the hand plate and accordingly is easily used without its being attached to the hand by means of tie downs which often become burdensome and awkward sometimes requiring the aid of a second person for tying and unfastening. It will be observed from FIGS. 1 and 3 that the protector is provided in the same width as the width of the hand plate and provides protection for the index, middle and third fingers.

A chin rest 60 can be provided on the hand plate and further aids in accuracy when shooting arrows by ensuring, after proper adjustment, that the string and arrow are always drawn to the same alignment before firing. That is, the chin rest as used in the present invention compliments the function of the hand plate and the combination is unique in at least one respect because of the compactness and the significant ease which facilitates usage. The chin rest in combination with the hand plate can be adjusted in many different directions in order to provide a proper fit with respect to the chin and jaw in conjunction with the hand plate. Accordingly, the chin rest may be adjusted forwardly or rearwardly, upwardly or downwardly, outwardly or inwardly with respect to the hand plate in order to accommodate the shape and size of the archer's chin in order to insure constant alignment of the bow string and arrow immediately prior to releasing the arrow thereby eliminating many variables which may affect accuracy during the firing process. The chin rest has the additional advantage of aiding the archer in shooting an arrow a greater distance. This advantage is achieved by raising the chin rest on the hand plate which results in the hand-string-arrow anchor point being lowered thereby changing the arrow firing setting for greater distance.

The hand plate of the present invention can be provided with a finger spacer 52 (FIG. 2) to ensure that the shaft of the arrow is held with constant pressure particularly at the time immediately prior to the arrow's release. This can affect accuracy in that the trajectory of the arrow is not significantly changed in successive shooting at least by virtue of the fact of varying pressures being used in holding the arrow immediately prior to firing. In FIG. 2, finger spacer 52 is shown mounted on the hand plate between index finger 130 and middle finger 132 (both illustratively shown by broken lines but not shown in FIG. 1). Preferably, finger spacer 52 is located between these fingers adjacent the palm of the hand. For purposes of securing the hand plate to the hand a fastener 54 can be provided, the fastener extending from finger spacer 52 to bottom edge 12 of the hand plate thereby securing said hand plate to middle finger 132 and third finger 134. It will be understood that other fastener means may be used to secure the hand plate to the archer's hand and such means are contemplated to be within the purview of the invention.

Thus, having described preferred embodiments of the invention, it will be understood that certain parts may be changed or modified and that such are contemplated to be within the scope of the invention. Further, while the invention has been described in terms of preferred embodiments, the claims appended hereto are intended to encompass other embodiments which fall within the spirit of the invention.

What is claimed is:

1. An archer's hand plate device adapted to be worn on an archer's hand when drawing and releasing a bow string and arrow, the device designed to increase accuracy and reproducibility in groups of shots, the device comprising:

(a) a base plate designed to fit in the palm of the archer's hand and to keep the back of said hand substantially flat and in line with fingers of the hand up to the first joint thereof, thereby maintaining knuckles of said fingers in line, the base plate being substantially flat and having, (i) a leading edge, (ii) a rear portion, (iii) a top portion, said top portion connecting the leading edge and the rear portion, the leading edge having a first portion and a second portion, said first portion of the leading edge of the base plate located rearward of said second portion of the leading edge, said first and second portion of the leading edge extending to about the first joint of the index and middle of fingers of said hand to make at least the index finger and middle finger of said hand bend at the first joint of said fingers when the hand is closed about said base plate, the rear portion of said plate adapted to fit against the heel of said hand when the hand is closed about said base plate, and (b) a finger spacer mounted on said base plate to fit between said index finger and said middle finger.

2. The device in accordance with claim 1 wherein said device has a shaped member mounted on the base plate and extends upwardly above the top portion, the member designed to fit under the chin and against the side of the jaw of the archer.

3. The device in accordance with claim 1 wherein the archery device has a means for attaching said device to said archer's hand.

4. The device in accordance with claim 1 having a finger protector attached thereto to protect at least said index finger and said middle finger against abrasions upon pulling the string of said bow.

5. An archer's hand plate device adapted to be worn in the palm of the archer's hand when drawing and releasing a bow string and arrow, the device designed to increase accuracy in reproducibility in groups of shots, the device comprising:

(a) a base plate designed to fit in the palm of the archer's hand and to keep the back of said hand substantially flat and in line with fingers of the hand up to the first joint thereof, thereby maintaining knuckles of said fingers in line, when said archer's hand is closed about said device the base plate being substantially flat and having
(i) a leading edge,
(ii) a rear portion and
(iii) a top portion, said top portion connecting the leading edge and the rear portion, the leading edge having a first portion and a second portion said first portion of the leading edge of the base plate located rearward of said second portion of the leading edge, said first and second portions of the leading edge extending to about the first joint of the index and middle fingers of said hand to make said fingers bend at the first joint thereof when the hand is closed about said base plate, the rear portion of said plate to fit against the heel of said hand when the hand is closed about said base plate;

(b) a finger spacer mounted on said base plate to fit between said index finger and said middle finger between the first joint of said fingers and the palm of said hand;

(c) a shaped member mounted on the top portion of the base plate to extend above the top portion, the member designed to fit under the chin and against the side of the jaw of the archer and being adjustable with reference to said base plate for purposes of adjusting said member to fit the contour of the archer's chin to provide for constant aligning of the bow string and arrow with respect to the archer's chin on successive shooting thereof;

(d) a finger protector attached thereto to protect at least said index finger and said middle finger against abrasions upon pulling said bow string; and (e) means for attaching said device to the archer's hand.

* * * * *